US009907713B2

(12) United States Patent
Dahlin et al.

(10) Patent No.: US 9,907,713 B2
(45) Date of Patent: Mar. 6, 2018

(54) WHEELCHAIR INCLUDING A TILTABLE SEAT

(71) Applicant: Invacare International Sarl, Gland (CH)

(72) Inventors: Edward Dahlin, Dio (SE); Mats Feldt, Almhult (SE)

(73) Assignee: INVACARE INTERNATIONAL SARL (CH)

( * ) Notice: Subject to any disclaimer, the term of this patent is extended or adjusted under 35 U.S.C. 154(b) by 385 days.

(21) Appl. No.: 14/704,086

(22) Filed: May 5, 2015

(65) Prior Publication Data

US 2015/0231004 A1 Aug. 20, 2015

Related U.S. Application Data

(63) Continuation-in-part of application No. PCT/IB2012/056195, filed on Nov. 6, 2012.

(51) Int. Cl.
*A61G 5/10* (2006.01)
*A61G 5/02* (2006.01)

(52) U.S. Cl.
CPC ..... *A61G 5/1075* (2013.01); *A61G 5/02* (2013.01); *A61G 5/104* (2013.01)

(58) Field of Classification Search
CPC ..... A61G 5/104; A61G 5/107; A61G 5/1075; A61G 5/1089; A61G 5/02
USPC ..... 280/250.1, 304.1, 220; 297/325, 329
See application file for complete search history.

(56) References Cited

U.S. PATENT DOCUMENTS 2,270,172 A * 1/1942 Ruegger ..... B60N 2/10 297/216.19
5,297,021 A * 3/1994 Koerlin ..... A61G 5/1067 180/907
5,971,482 A * 10/1999 Goertzen ..... A61G 5/00 297/322

(Continued)

FOREIGN PATENT DOCUMENTS

WO 04/039299 5/2004

OTHER PUBLICATIONS

International Search Report and Written Opinion from PCT/IB2012/056195 dated Jul. 30, 2013.

*Primary Examiner* — Anne Marie M Boehler
(74) *Attorney, Agent, or Firm* — Calfee, Halter & Griswold LLP

(57) ABSTRACT

An exemplary wheelchair comprises a main frame and a seat frame. Drive wheels and pivoting caster wheels are affixed to and support the main frame. The seat frame is connected to the main frame via left and right rear linkage arms, each rear linkage arm having a first end pivotally connected to the main frame and a second end pivotally connected to the seat frame, thereby allowing the seat frame to pivot relative to the main frame around a virtual pivot point. A seat plate having right, left, front, and rear sides is supported by the seat frame. A backrest frame is also connected to the seat frame. Left and right guide slots of the seat frame receive left and right guide rollers rotationally arranged at each end of a laterally oriented shaft connected to the main frame. The rear linkage arms and guide slots are configured so the virtual pivot point of the seat frame moves rearward when the seat frame is moved from an upright position to a tilted position.

22 Claims, 7 Drawing Sheets

(56) References Cited

U.S. PATENT DOCUMENTS

| | | | | |
|---|---|---|---|---|
| 6,003,891 | A * | 12/1999 | Broadhead | A61G 5/045<br>180/907 |
| 6,126,186 | A | 10/2000 | Mascari | |
| 6,425,635 | B1 * | 7/2002 | Pulver | A61G 5/107<br>297/325 |
| 6,976,699 | B2 * | 12/2005 | Koerlin | A61G 5/006<br>280/304.1 |
| 7,722,114 | B2 * | 5/2010 | Smith | A47C 1/0352<br>297/340 |
| 9,010,787 | B2 * | 4/2015 | Slagerman | A61G 5/1075<br>280/250.1 |
| 2011/0215624 | A1 * | 9/2011 | Laslo | A61G 5/10<br>297/329 |

* cited by examiner

WHEELCHAIR INCLUDING A TILTABLE SEAT

RELATED APPLICATIONS

The present application is a continuation-in-part of PCT/IB2012/056195, filed on Nov. 6, 2012, the entire disclosure of which is fully incorporated herein by reference.

TECHNICAL FIELD

The present invention relates to wheelchairs in general, and more particularly to wheelchairs in which the seat can tilt relative to the frame, i.e., where the entire seat moves from an upright position to a tilted position.

The invention is particularly applicable to a manually operated wheelchair and will be described with reference thereto. However, it will be appreciated that the invention has broader applications and may also be employed in a power wheelchair.

BACKGROUND OF THE INVENTION

Known seating systems for wheelchairs allow the entire seat to pivot about a fixed point. In general, this fixed pivot point is positioned so as to coincide with the vertical center of mass of an individual sitting in the wheelchair. The result of tilting the seat about this fixed pivot point is that relatively little effort is required to rotate the individual. However, the problem with such an arrangement is that the user's knees moves significantly upward as the seat is tilted. Thus, in the tilted position of the seat, the user can not touch the ground with his feet, thereby preventing him to self-propel the wheelchair using his feet. Furthermore, the upward movement of the user's knees during the tilting of the wheelchair may be problematic when the wheelchair user is at a location with a limited freedom of movement for the knees, for instance underneath a table top.

For solving this problem, other known seating systems for wheelchairs are configured such that the fixed pivot point is positioned near the front of the seat. In this case, the distance from the knees to the ground does not vary significantly during the tilting of the wheelchair, thereby allowing the self-propelling of the wheelchair by the user with his feet in the tilted position of the seat. However, the problem with such an arrangement is that the back of the seat moves significantly downward as the seat is tilted. Thus, with such an arrangement, a risk potentially exists that the back of the seat hits the ground or a part of the frame as the seat is tilted. To avoid this problem, the seat must be sufficiently raised relative to the frame, leading to a significant increase of the total height of the wheelchair. Furthermore, because the center of gravity of the seat, and therefore of the user, is positioned behind the pivot point, a risk potentially exists that the user could fall backward as the seat is tilted.

SUMMARY

Exemplary embodiments of wheelchairs having tiltable seats are disclosed herein.

In one exemplary embodiment, a wheelchair comprises a main frame and a seat frame. Drive wheels and pivoting caster wheels are affixed to and support the main frame. The seat frame is connected to the main frame via left and right rear linkage arms, each rear linkage arm having a first end pivotally connected to the main frame and a second end pivotally connected to the seat frame, thereby allowing the seat frame to pivot relative to the main frame around a virtual pivot point. A seat plate having right, left, front, and rear sides is supported by the seat frame. A backrest frame is also connected to the seat frame. Left and right guide slots of the seat frame receive left and right guide rollers rotationally arranged at each end of a laterally oriented shaft connected to the main frame. The rear linkage arms and guide slots are configured so the virtual pivot point of the seat frame moves rearward when the seat frame is moved from an upright position to a tilted position.

BRIEF DESCRIPTION OF THE DRAWINGS

These and other features and advantages of the present invention will become better understood with regard to the following description and accompanying drawings in which.

DETAILED DESCRIPTION

For the purpose of the present specification, situations and directions of elements of the wheelchair of the present invention are determined by the perspective of a user seated in the wheelchair. Accordingly, the rear side of the wheelchair corresponds to the top left side of FIG. 1. The situations or directions "up" or "top" and "down" or "bottom", "rear" or "back" and "front", "behind" and "in front", "upper" and "lower", "lateral" and "central" follow the same rule. A longitudinal direction corresponds to a back-to-front direction and a lateral direction corresponds to a left-to-right direction. The horizontal corresponds to the plane tangential to the rear and front wheels and positioned under said wheels when the wheelchair is its normal position of use. A horizontal plane corresponds to a plane parallel to the horizontal. The vertical, or a vertical plane, corresponds to a plane perpendicular to the horizontal. In the following specification, the expressions "clockwise direction" or "anticlockwise direction" refer to a pivoting movement of the seat when the seat is viewed on its left side.

A first objective of the present invention is to provide a wheelchair which is specifically designed so that the user's knees move upwardly only slightly as the wheelchair is tilted, therefore allowing the user to self propel the wheelchair using his feet and permitting to tilt the seat even if the space above the user's knees is limited. A second objective of the present invention is to provide a wheelchair comprising a tiltable seat in which the dimensions of the wheelchair, in particular its total height, are conventional or substantially conventional. A third objective of the present invention is to provide a wheelchair comprising a tiltable seat in which the risk that the user falls backwards as the seat is tilted is low or quasi null. A fourth objective of the present invention is to provide a wheelchair comprising a tiltable seat which can be easily tilted by the user himself.

Figure 1:
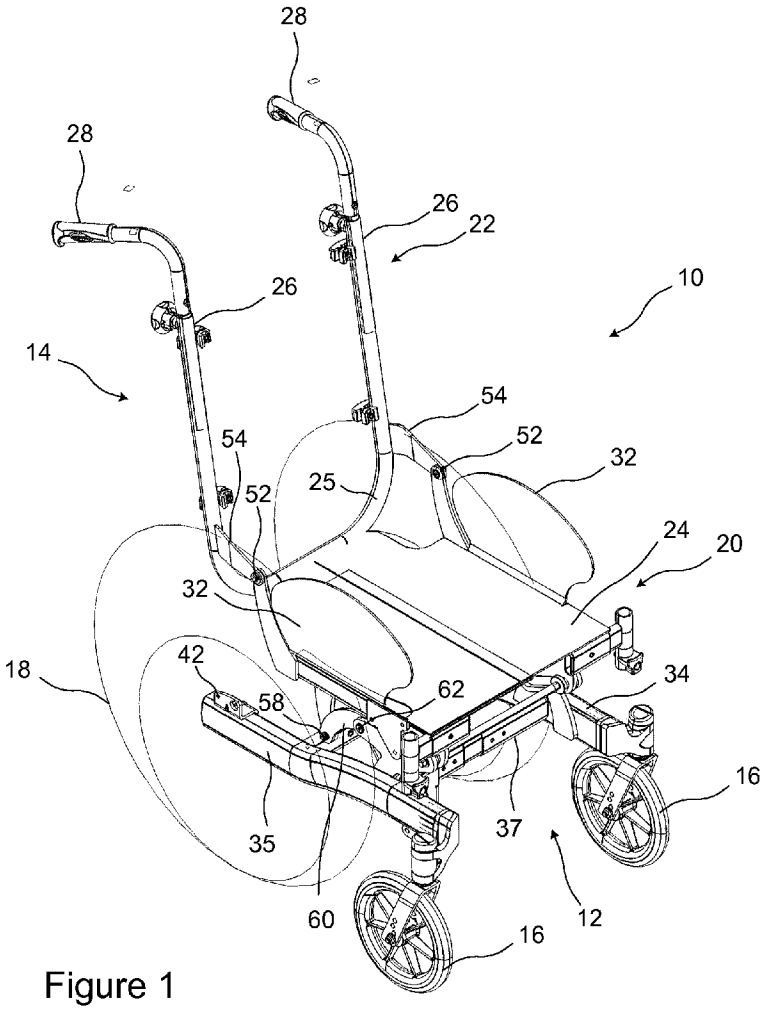
FIG. 1 is a front perspective view of an exemplary wheelchair with the seat frame in an upright position.

FIG. 1 shows a wheelchair according to the present invention. The wheelchair 10 comprises a main frame 12 and a seat assembly 14 supported by the main frame. The main frame 12 is supported above the ground by wheels, such as the front wheels 16 and the rear wheels 18 shown. The front wheels 16 are preferably casters and the rear wheels 18 are preferably drive wheels, which may be manually or power driven. The seat assembly 14 has a seat frame 20 and a backrest frame 22. The seat frame 20 includes longitudinally extending frame members, such as tubes 44, 45 (FIG. 6), for supporting a seat plate 24, which can be in the form of a semi-rigid or rigid pan, as shown, or a resilient or pliable sling (not shown). The backrest frame 22 preferably includes laterally spaced canes 26 for supporting a backrest (not shown). The canes 26 are preferably formed of adjustable parts, such as the telescopic tubes shown, that permit the length of the canes 26, and thus the backrest frame 22, to be adjusted. A handle 28 may be supported by each of the canes 26, preferably by couplings that are adapted to releasably hold the handles 28 in a fixed relation to the canes 26.

The seat frame 20 is preferably adapted to support armrests 32 and footrest assemblies (not shown). The armrests 32 are preferably releasably attached to the seat frame 20 and movable in a longitudinal direction relative to the seat frame 20. The armrests 32 are preferably held in fixed relation to the seat frame 20 in any conventional manner. The footrest assemblies are also releasably and movably attached to the seat frame 20.

Figure 5:
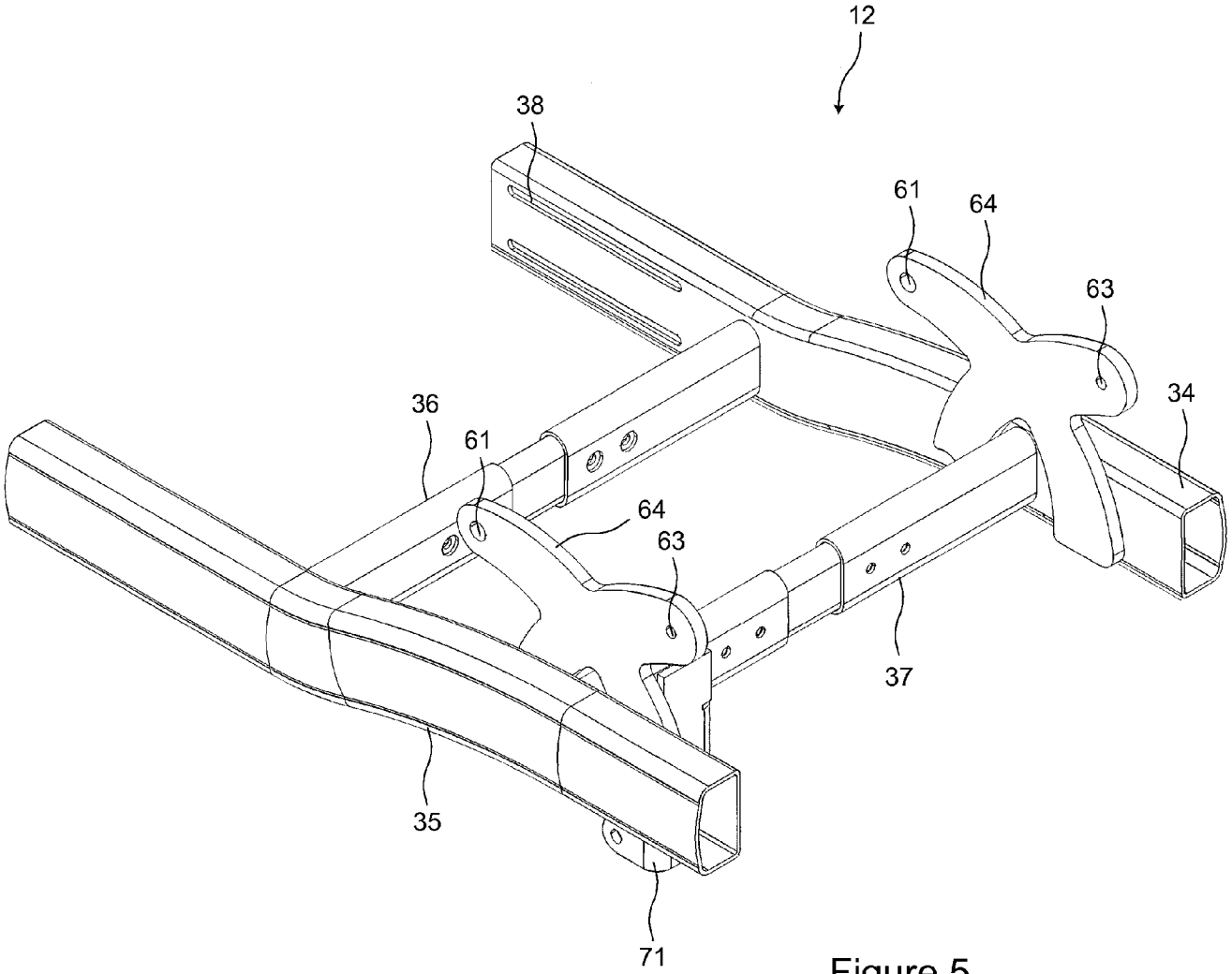
FIG. 5 is a perspective view of a main frame of the wheelchair of FIG. 1.

As illustrated in FIGS. 1 and 5, the main frame 12 is comprised of opposing side frame members, such as the left tube 34 and the right tube 35 shown, joined by a pair of longitudinally spaced, laterally extending frame members, such as the rear tube 36 and the front tube 37 shown. It should be noted that the laterally extending tubes 36, 37 are preferably in the form of telescopic tubes that are adjustable relative to one another to permit the wheelchair 10 to grow in width. It should further be noted that each tube 34, 35 can preferably be provided with longitudinally extending, parallel slots 38 so as to releasably attach an axle mounting element 42 adapted to rotably connect a drive wheel 18. Fasteners (not shown) can be adapted to be secured in the slots 38 to hold the axle mounting element 42 in a substantially fixed relation to the side tubes 34, 35. To adjust the position of the pivot axis of the drive wheel 18 along the longitudinal direction, the fasteners may simply be removed and the axle mounting elements 42 may be moved longitudinally. This permits the weight of the wheelchair occupant to be adjusted longitudinally with respect to the wheels, for example, to optimize steering performance and stability.

Figure 6:
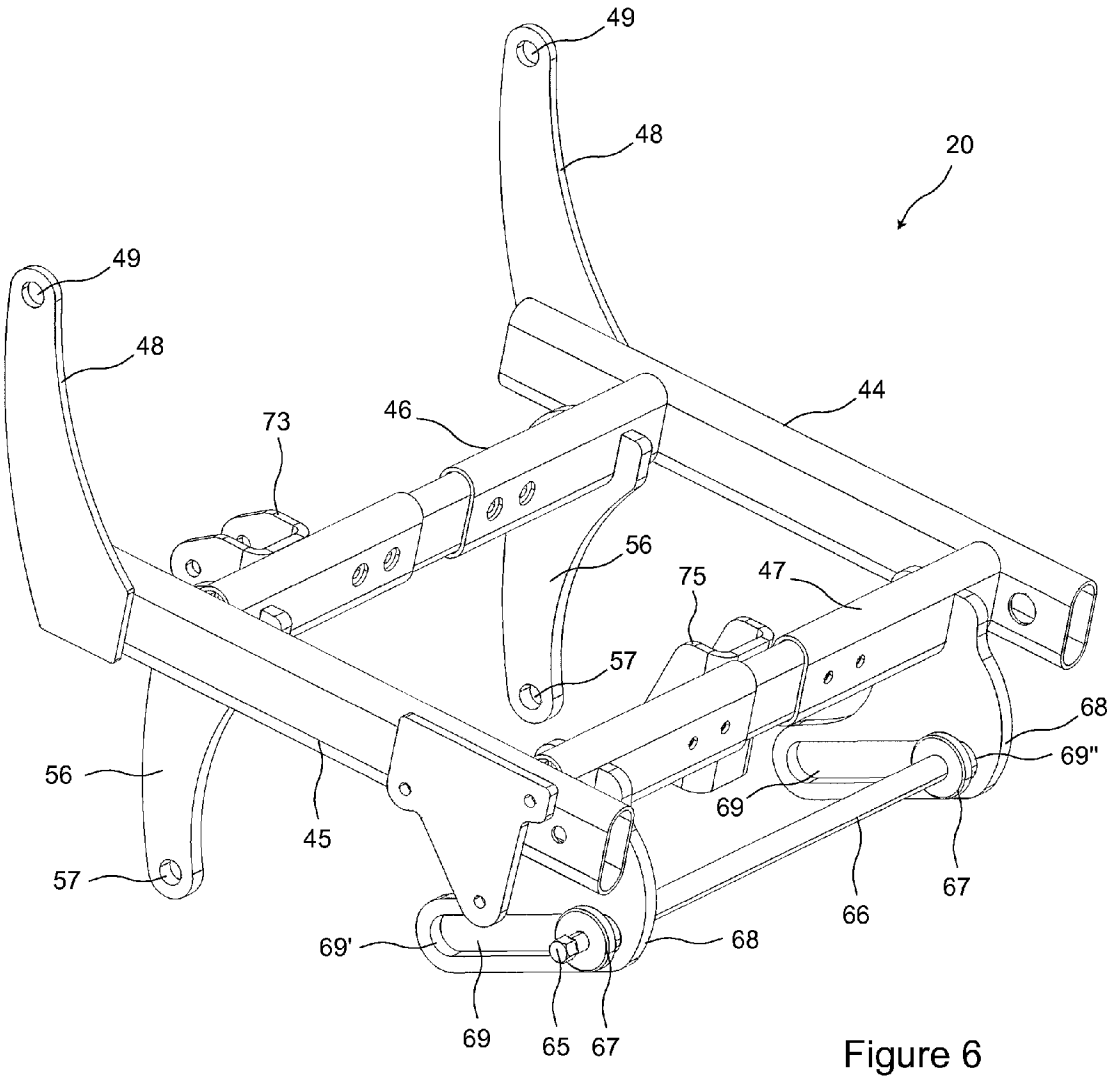
FIG. 6 is a perspective view of a seat frame of the wheelchair of FIG. 1.

As illustrated in FIG. 6, the seat frame 20 is similarly comprised of side frame members, such as the left and right tubes 44 and 45 shown, joined by a pair of longitudinally spaced, laterally extending members, such as the rear and front tubes 46 and 47 shown. It should be noted that the laterally extending tubes 46, 47 are preferably in the form of telescopic tubes that are adjustable relative to one another to permit the wheelchair 10 to grow in width. The seat frame 20 comprises a first pair of substantially vertical rear flanges 48 extending upwardly from a rear end of the left and right side tubes 44 respectively, typically being rigidly secured thereto by welding or the like. Each flange 48 is provided with a laterally extending through-hole 49 at its upper end so as to receive a fastener 52 adapted to fixedly attach the flange 48 to a corresponding flange 54 provided in the lower part of one of the canes 26 of the backrest frame 22. However, in a further embodiment of the invention (not shown), the fasteners 52 can be adapted to pivotally attach the flanges 48 to the flanges 54.

The seat frame 20 also comprises a second pair of substantially vertical rear flanges 56 extending downwardly near the left and right ends of the rear tube 46 respectively, typically being rigidly secured thereto by welding or the like. Each flange 56 is provided with a laterally extending through-hole 57 at its lower end so as to receive a fastener 58 adapted to pivotally attach the lower end of a left or right rear linkage arm 60. Said rear linkage arms 60 may preferably be curve-shaped, such as shown in FIG. 1, or straight. As illustrated in FIG. 1, the upper ends of the left and rear linkage arms 60 are pivotally attached to the main frame 12 via a fastener 62 which is received in a laterally extending through-hole 61 (FIG. 5) provided in a rear end of left and right front flanges 64 extending upwardly near the front end of the left and right side tubes 44, 45 and typically being rigidly secured thereto by welding or the like. The left and right front flanges 64 are also provided at their front ends with laterally extending through holes 63 to receive fasteners 65 adapted to fixedly attach the left and right ends of a laterally oriented shaft 66. Two guide rollers 67 are rotationally arranged along said shaft 66. The guide rollers 67 are adapted to be received in and guided by left and right guide slots 69 of left and right front flanges 68 that extend downwardly near the left and right ends of the front tube 47 and are typically rigidly secured thereto by welding or the like. In the embodiment shown, the guide slots 69 are straight and extend from a rear end 69' to a front end 69" in an upward and frontward direction. In a further embodiment (not shown) of the invention, the guide slots 69 may be curved and/or extend from the rear end 69' to the front end 69" in a downward and frontward direction.

Figure 2:
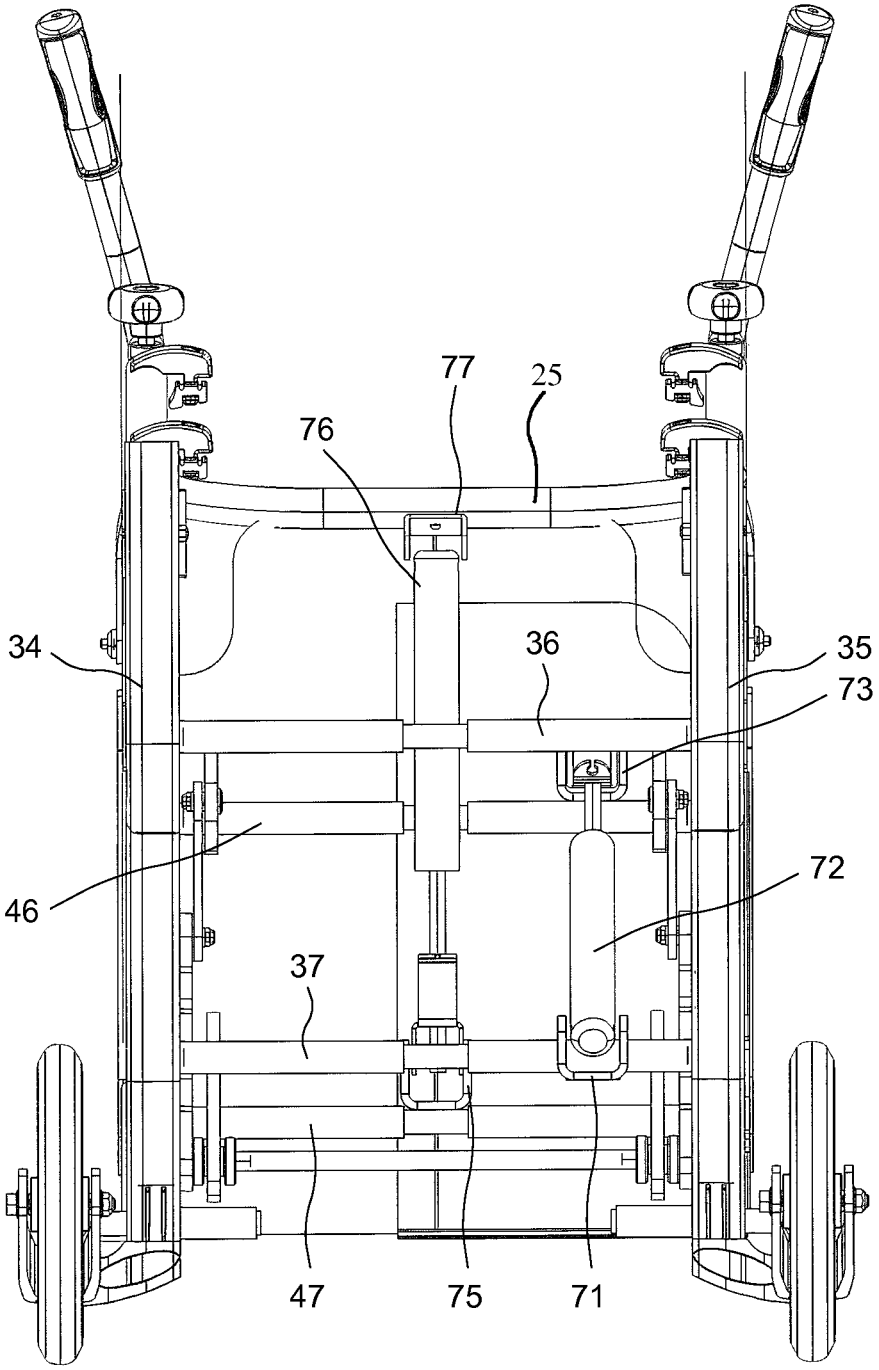
FIG. 2 is a bottom view of the wheelchair of FIG. 1.
Figure 3:
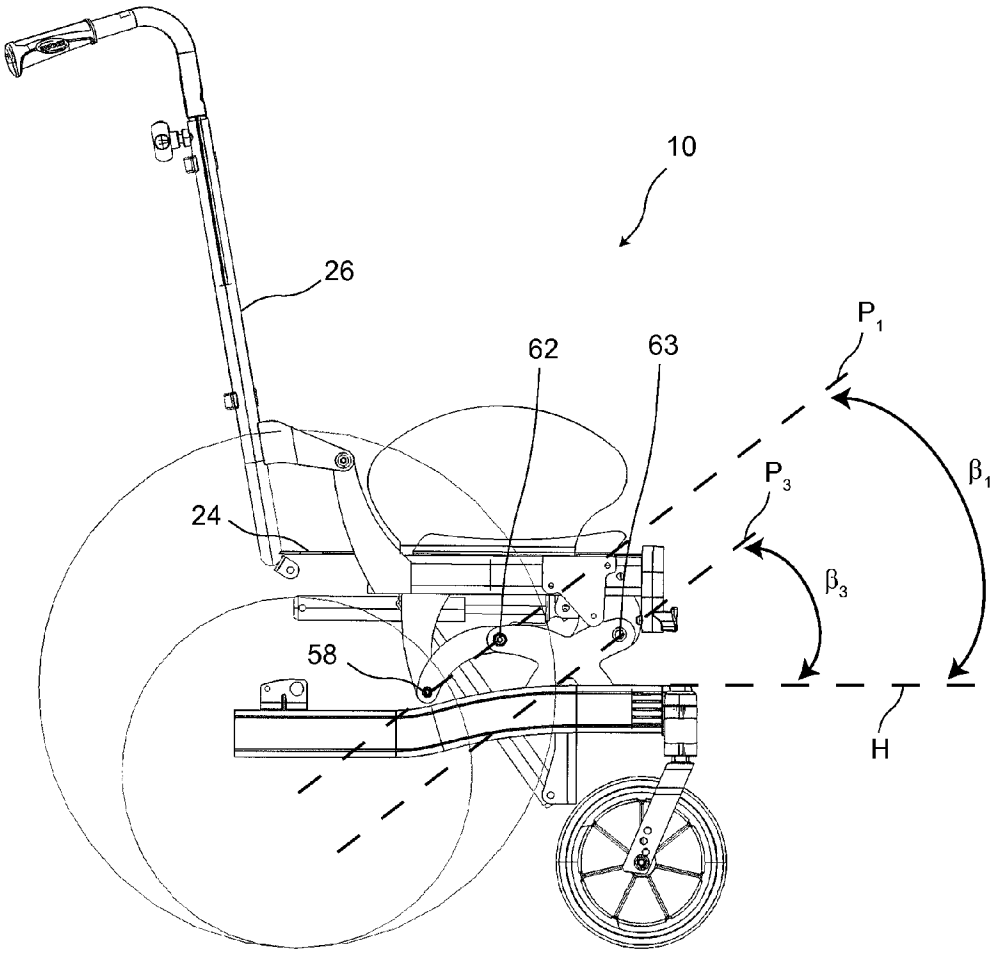
FIG. 3 is a side elevation view of the wheelchair of FIG. 1.

Thus configured, the seat frame 20 can be tilted relative to the main frame 12 between an upright position illustrated in FIG. 3, in which the guide rollers 67 abut the front ends 69" of the guide slots 69, and an entirely tilted position (not shown), in which said guide rollers 67 abut the rear ends 69' of the guide slots 69. This tilting can be made by the user-, for instance, by simply moving his center of mass rearward relative to the center of mass of the wheelchair, or by an attendant, for instance, by simply pulling rearward on the handles 28 and keeping the position of the drive wheels constant. However, so as to prevent an inopportune tilting of the seat frame, the wheelchair 10 may preferably comprise at least one locking means adapted to hold in position the seat frame 20 relative to the main frame 12. In a preferred embodiment of the present invention, such a locking means may comprise a first linear actuator connected at a first end to the seat frame 20 and at a second end to the main frame 12, said first linear actuator being adapted to maintain the distance between said first end and said second end. As shown in FIG. 2, this first linear actuator may comprise an air piston 72 pivotally connected at one end to a U-shape element 71 fixedly connected to the front tube 37 of the main frame 12 and at the other end to a U-shape element 73 fixedly connected to the rear tube 46 of the seat frame 20. However, in a further embodiment of the invention (not shown), the first linear actuator can also be electrically driven. Thus, when the user wants to modify the angular position of the seat frame 20 relative to the main frame 12, he can control the first linear actuator so as to stop the pneumatic or electromechanical force preventing the modification of the distance between its ends. The control of the first linear actuator may advantageously be made by the user-via a control panel, a button, or a lever positioned in the wheelchair near his left or right hand. Such a control panel, button or lever may advantageously be configured so as to also permit the reduction or the reversal of the pneumatic or electromechanical force provided by the first linear actuator, thereby restraining or facilitating the tilting operation of the seat frame 20. In addition to the first linear actuator, the wheelchair 10 may advantageously be provided with a second linear actuator connected at a first end to the backrest frame 22 and at a second end to the seat frame 20, said second linear actuator being adapted to push or to pull a lower part of the backrest frame 22 in a linear direction, thereby facilitating the tilting of the backrest frame 22 from an upright position to a tilted position or vice versa. As shown in FIG. 2, this second linear actuator may consist in an air piston 76 pivotally connected at one end to a U-shape element 75 fixedly connected to the front tube 47 of the seat frame 20 and at the other end to a U-shape element 77 fixedly connected to a linking tube 25 joining the two canes 26 in their lower part. In a further embodiment of the invention (not shown), the second linear actuator can also be electrically driven. The control of the second linear actuator may advantageously be made by the user via a control panel, a button, or a lever positioned in the wheelchair near his left or right hand.

Thus configured, the wheelchair 10 of the present invention allows the seat frame 20 to move from its upright position to its entirely tilted position without being pivotally connected to the main frame around a fixed pivot point. Indeed, during the tilting of the seat frame 20, the movement of the center of gravity thereof can be approximated to a pivotal movement around a virtual pivot point. But, contrary to the known solutions, the position of this virtual pivot point is not fixed. In particular, the rear linkage arms 60 and the guide slots 69 of the seat frame 20 may advantageously be configured so that the virtual pivot point around which pivots the seat frame moves rearward when the seat frame moves from its upright position to its entirely tilted position. This rearward movement of the virtual pivot point confers several advantages. First, the virtual pivot point may be positioned near the front of the seat when the seat begins to be tilted, thereby allowing the user to self-propel the wheelchair using his feet. Second, the virtual pivot point may be positioned near the vertical center of mass of the user sitting in the wheelchair when the seat is entirely or partially tilted, thereby preventing the user from falling backwards.

Figure 4:
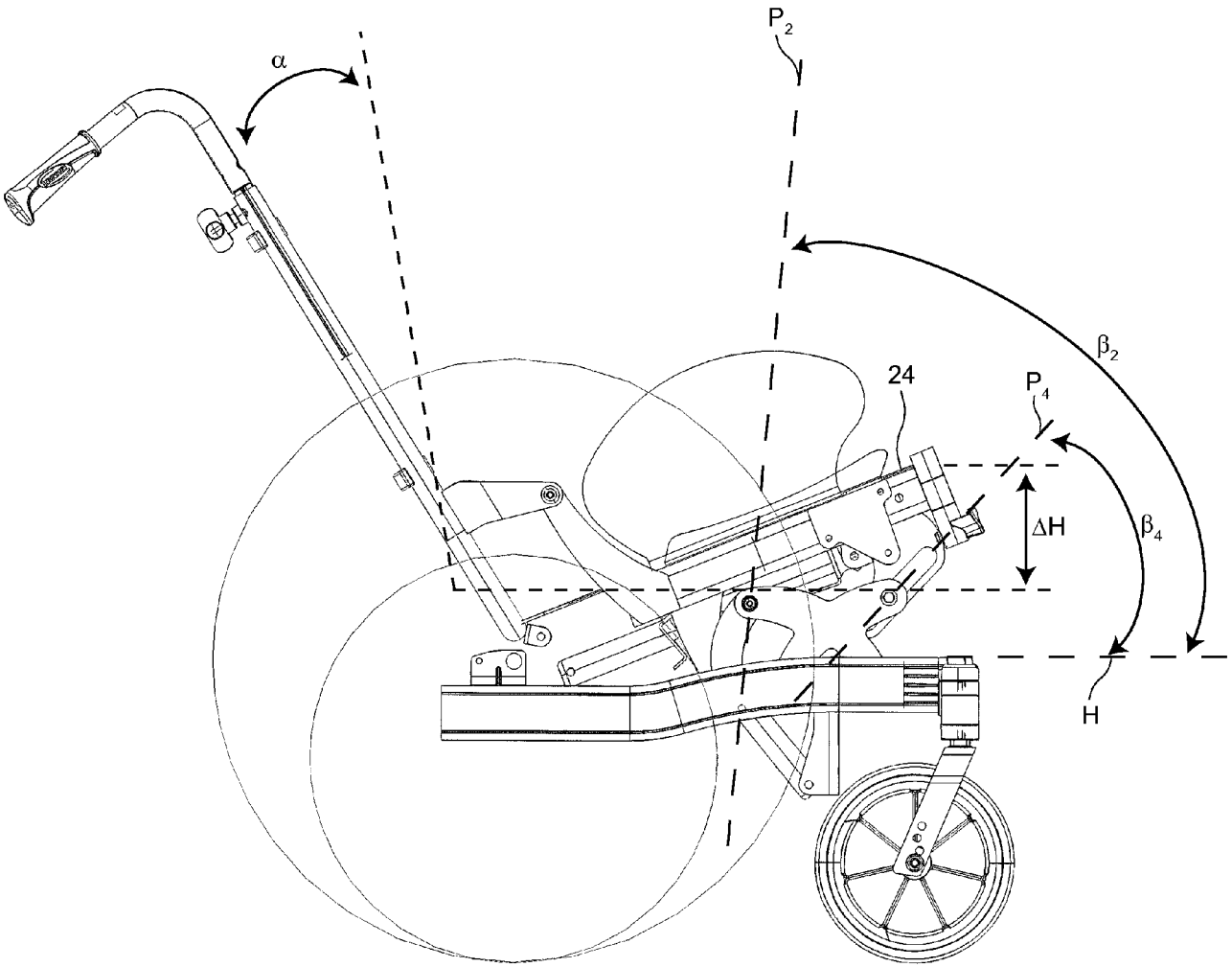
FIG. 4 is a side elevation view of the wheelchair of FIG. 1 with the seat frame in a partially tilted position.
Figure 7:
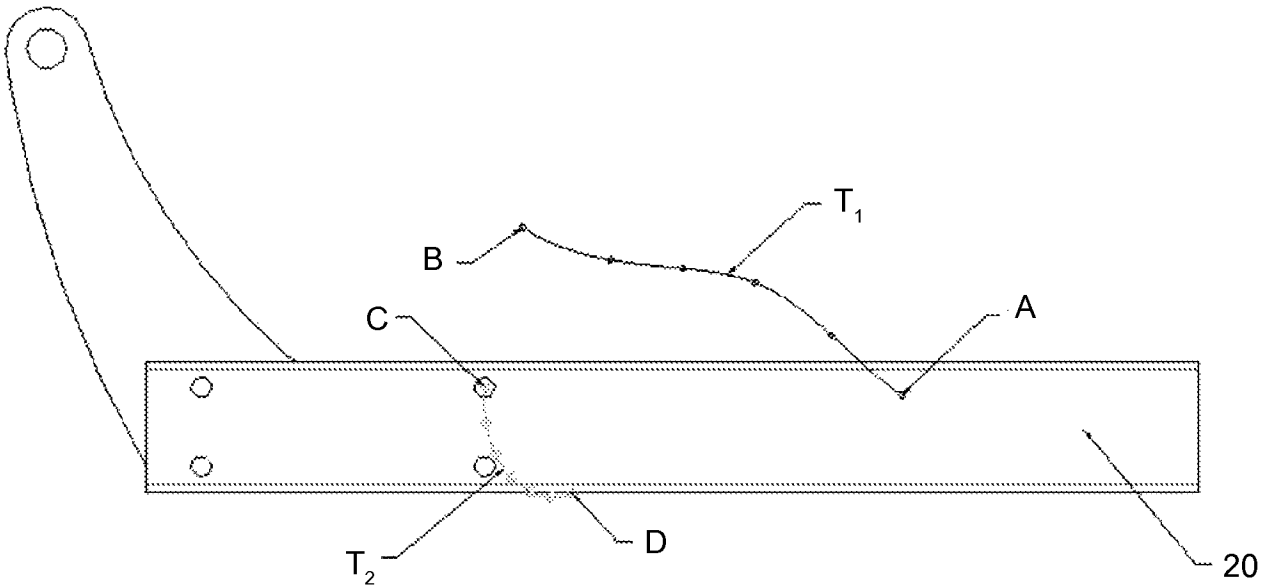
FIG. 7 is a side view of the seat frame of the wheelchair of FIG. 1 showing successive positions of a virtual pivot point as the seat frame is tilted from the upright position to the partially tilted position.

FIG. 7 illustrates the trajectory T1 followed by the virtual pivot point of the seat frame 20 when the seat frame is tilted between its upright position illustrated in FIG. 3 to its partially tilted position illustrated in FIG. 4. During this tilting operation, a point C of said seat frame 20 positioned in the rear part thereof follows a trajectory T2 and reaches a point D. During this movement, the point C is moving downward and forward. At the same time, the virtual pivot point of the seat frame 20 moves upward and rearward from the position A to the position B. In the position A, the virtual pivot point is near the front of the seat and, in the position B, the virtual pivot point is near the vertical center of mass of the user.

As illustrated in FIG. 3, with the seat frame 20 in the upright position, the seat plate 24 is substantially horizontal and the canes 26 of the backrest frame 22 are substantially vertical or slightly inclined rearward relative to the vertical. The pivot points 58 and 62 at the lower and upper ends, respectively, of the left and right rear linkage arms 60 define a plane P1, which is inclined relative to the horizontal H. The angle β1 between plane P1 and the horizontal H may preferably be between 20 and 40 degrees, and, more preferably, be approximately 30 degrees. The guide slots 69 of the left and right front flanges 68 are substantially aligned in a plane P3, which is inclined relative to the horizontal H. The angle β3 between plane P3 and the horizontal H may preferably be between 20 and 40 degrees, and, more preferably, be approximately 30 degrees. In addition, the seat frame 12 may advantageously be configured so that the through-holes 61 and 63—in the left and right front flanges 64 are positioned in an approximately horizontal plane.

As illustrated in FIG. 4, with the seat frame 20 in the partially tilted position, the canes 26 of the backrest frame 22 are inclined at an angle α relative to their positions shown in FIG. 3 (illustrated with a broken line in FIG. 4). The seat plate 24 is also inclined at the same angle α relative to its position shown in FIG. 3 (illustrated with a broken line in FIG. 4). The pivot points 58 and 62 at the lower and upper ends, respectively, of the left and right rear linkage arms 60 define a plane P2, which is inclined relative to the horizontal H. When the seat frame 20 is positioned in its entirely tilted position, the angle β2 between-plane P2 and the horizontal H may preferably be between 80 and 90 degrees, and, more preferably, be approximately 85 degrees. The guide slots 69 of the left and right front flanges 68 are substantially aligned in a plane P4, which is inclined relative to the horizontal H. When the seat frame 20 is positioned in its entirely tilted position, the angle β4 between-plane P4 and the horizontal H may preferably be between 50 and 70 degrees, and, more preferably, be approximately 60 degrees.

The rear linkage arms 60 and the guide slots 69 are thus configured to define a virtual pivot point around which the seat frame 20 pivots during its tilting, said virtual pivot point moving rearward as the seat is tilted. In particular, the rear linkage arms 60 and the guide slots 69 are configured so that the front side of the seat plate 24 moves slightly upward when the angle α is less than 10 degrees. Preferably, the rear linkage arms 60 and the guide slots 69 may be configured so that the front side of the seat plate 24 moves upward by a distance ΔH when the angle α is substantially equal to 10 degrees, the distance ΔH being less than 25 mm. Preferably, the rear linkage arms 60 and the guide slots 69 may also be configured so that the front side of the seat plate 24 moves less than 100 mm upward when the angle α is substantially equal to 30 degrees.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

The invention claimed is:

1. A wheelchair comprising:

a main frame;

a pair of drive wheels affixed to and supporting said main frame;

a pair of caster wheels each pivotally mounted to and supporting said main frame;

a seat frame connected to the main frame via left and right rear linkage arms, each rear linkage arm, respectively, having one first end pivotally connected to the main frame at a first pivot point and one second end pivotally connected to the seat frame at a second pivot point;

a seat plate supported by the seat frame and defined by rear and front sides and left and right sides;

a backrest frame connected to the seat frame;

two guide rollers rotationally arranged along a laterally oriented shaft, said shaft being connected to the main frame and each guide roller, respectively, being received in and guided by a guide slot arranged in the seat frame;

wherein the rear linkage arms and the guide slots are configured to define a virtual pivot point around which the seat frame pivots, and said virtual pivot point moves rearward when the seat frame moves from an upright position to a tilted position.

2. The wheelchair of claim 1, wherein the rear linkage arms and the guide slots are configured such that the front side of the seat plate moves less than 25 mm upward when the seat frame is tilted to 10 degrees in the anticlockwise direction from its upright position.

3. The wheelchair of claim 1, wherein the rear linkage arms and the guide slots are configured such that the front side of the seat plate moves less than 100 mm upward when the seat frame is tilted to 30 degrees in the anticlockwise direction from its upright position.

4. The wheelchair of claim 1, wherein the laterally oriented shaft and the second pivot points of the left and right rear linkage arms are positioned in an approximately horizontal plane.

5. The wheelchair of claim 1, wherein, in the upright position of the seat frame, the first and second pivot points of the left and right rear linkage arms are positioned in a first plane, said first plane being inclined relative to the horizontal at an angle β1.

6. The wheelchair of claim 5, wherein the angle β1 between the first plane and the horizontal lies between 20 and 40 degrees.

7. The wheelchair of claim 6, wherein the angle β1 is approximately equal to 30 degrees.

8. The wheelchair of claim 1, wherein, in the tilted position of the seat frame, the first and second pivot points of the left and right rear linkage arms are positioned in a second plane, said second plane being inclined relative to the horizontal at an angle β2.

9. The wheelchair of claim 8, wherein the angle β2 between the second plane and the horizontal lies between 80 and 90 degrees.

10. The wheelchair of claim 9, wherein the angle β2 is approximately equal to 85 degrees.

11. The wheelchair of claim 1, wherein the guide slots are straight.

12. The wheelchair of claim 11, wherein, in the upright position of the seat frame, the guide slots are substantially aligned in a third plane, said third plane being inclined relative to the horizontal at an angle β3.

13. The wheelchair of claim 12, wherein the angle β3 between the third plane and the horizontal lies between 20 and 40 degrees.

14. The wheelchair of claim 13, wherein, in the tilted position of the seat frame, the guide slots are substantially aligned in a fourth plane, said fourth plane being inclined relative to the horizontal at angle β4, and wherein the angle β4 between the fourth plane and the horizontal lies between 50 and 70 degrees.

15. The wheelchair of claim 14, wherein the angle β4 is approximately equal to 60 degrees.

16. The wheelchair of claim 13, wherein the angle β3 is approximately equal to 30 degrees.

17. The wheelchair of claim 1, wherein, in the tilted position of the seat frame, the guide slots are substantially aligned in a fourth plane, said fourth plane being inclined relative to the horizontal.

18. The wheelchair of claim 1, wherein the left and right rear linkage arms are curve-shaped.

19. The wheelchair of claim 1, said wheelchair further comprising at least one locking element adapted to hold in position the seat frame relative to the main frame, thereby preventing an inopportune tilting of the seat frame.

20. The wheelchair of claim 19, wherein said at least one locking element comprises a first linear actuator connected at a first end to the seat frame and at a second end to the main frame, said first linear actuator being adapted to keep unchanged the distance between said first end and said second end.

21. The wheelchair of claim 20, wherein said first linear actuator is adapted to provide a pneumatic or electromechanical force so as to prevent, restrain or facilitate the movement of the seat frame relative to the main frame.

22. The wheelchair of claim 20, wherein the backrest frame is pivotally connected to the seat frame, the wheelchair further comprising at least one second linear actuator connected at a first end to the backrest frame and at a second end to the seat frame, said second linear actuator being adapted to push or to pull a lower part of the backrest frame, thereby facilitating the tilting of the backrest frame from an upright position to a tilted position or vice versa.

* * * * *